United States Patent [19]

Kinderov et al.

[11] Patent Number: 4,702,860

[45] Date of Patent: Oct. 27, 1987

[54] CURRENT-CONDUCTING COMPOSITION

[75] Inventors: Petr A. Kinderov; Nikolai S. Volkov; Natalia V. Vasilieva; Regina T. Malashkina, all of Tashkent, U.S.S.R.

[73] Assignee: Nauchno-Issledovatelsky Institut Kabelnoi Promyshlennosti Po "Sredazkabel" , U.S.S.R.

[21] Appl. No.: 815,761

[22] Filed: Jan. 2, 1986

Related U.S. Application Data

[63] Continuation of Ser. No. 620,871, Jun. 15, 1984, abandoned.

[51] Int. Cl.[4] ..... H01B 1/06

[52] U.S. Cl. ..... 252/511; 252/502; 252/503

[58] Field of Search ..... 252/502, 503, 511, 495, 252/496, 506

[56] References Cited

U.S. PATENT DOCUMENTS 4,414,142 11/1983 Vogel et al. ..... 252/511

FOREIGN PATENT DOCUMENTS 758262 8/1980 U.S.S.R. .

*Primary Examiner*—Paul Lieberman
*Assistant Examiner*—Hoa Van Le
*Attorney, Agent, or Firm*—Ladas & Parry

[57] ABSTRACT

A current-conducting composition comprising a polymeric base and a current-conducting carbon black with its carbon being chemically combined with 0.18–0.5% by mass of boron and having a specific adsorption surface area of 60 to 110 $m^2/g$ with the following proportions of the components, parts by mass:

polymeric base: 100 current-conducting carbon black: 38–240.

5 Claims, No Drawings

CURRENT-CONDUCTING COMPOSITION

This is a continuation of application Ser. No. 620,871, filed June 15, 1984, now abandoned.

FIELD OF THE INVENTION

The present invention relates to polymeric compositions possessing current-conducting properties.

The compositions according to the present invention are useful in the tire manufacture, cable industry, manufacture of rubber-engineering goods, as aircraft and automobile tires, cable braidings instead of copper ones, for the production of antistatic films, electrodes, sensors, heating elements, fuel tanks.

BACKGROUND OF THE INVENTION

At present many countries are interested in the manufacture of such current-conducting compositions, since the latter combine the advantages of such different components as polymers and metals.

They feature high corrosion resistance, processibility into shaped articles and the ability of being used under multiple deformations; they can replace critical non-ferrous and precious metals.

The known current-conducting compositions contain a polymeric base and a filler. As the polymeric base elastomers (often silicone ones) are used, as well as thermoplastics (polyethylene, polypropylene, copolymers of both), phenol-formaldehyde and epoxy resins. As the current-conducting fillers carbon blacks are employed such as acetylene carbon black, gas carbon black, lamp carbon black, channel carbon black. To improve the current conductivity, elasticity and durability of current-conducting compositions, the carbon black surface is treated with various reagents.

The company Canric Petriks Chemicals has developed a whole range of organotitanates for treating fillers with a view to improving the electrical conductivity and other properties of current-conducting compositions (cf. Plast. Technol., 1975, 22, No. 8, p. 71).

In a number of publications it has been suggested to introduce calcium, barium, strontium in a combined or elemental state during the combustion of a hydrocarbon stock in order to improve electrical conductivity of a filler - carbon black (cf. British Pats. Nos. 2,098,972 and 2,094,773).

In recent years a carbon black of the brand "Ketjenblack E.C." available from the company "Akzo-Chemie, Niederlande" has acquired an extensive use as a filter. It comprises a gas carbon black obtained as a result of combustion of a hydrocarbon feedstock with special additives ensuring its high porosity and an enormous surface area due to the presence of a great number of hollow particles. The carbon black "Ketjenblack E.C." has the electrical resistance (at the density of 180 kg/m$^3$) of 0.005 Ohm·m, its yield is 5%, cost: $2,500 per ton; it is produced on a limited scale and is but hardly available. An electrically-conducting composition containing 15 parts by mass of this carbon black per 100 parts by mass of a polymer has an electric resistance of not more than 0.1 Ohm·m (cf. U.S. Pat. No. 3,723,355).

Known in the art is a process for producing a carbon-plastic electrode structure for an electrochemical device (U.S. Pat. No. 4,164,068), wherein a thin current-conducting carbon-plastic sheet is injection-moulded from thermoplastics or thermosetting resins filled with carbon blacks of brands "Ketjenblack E.C." (Noury Chemical Corp., New York) and "Vulkan XC-72" (Cabot Corp.) A carbon-plastic sheet has an electric resistance within the range of from 0.001 to 0.05 Ohm·m.

Known is a current-conducting composition (cf. U.S. Pat. No. 4,273,097) containing 7 parts by mass of a carbon black in the form of hemispherical particles with the surface area of 900 m$^2$/g (which corresponds to characteristics of the carbon black "Ketjenblack E.C.") having an electrical resistance with-in the range of from 0.01 to 1.00 Ohm·m.

A process is known for the production of polymeric compositions with an electric resistance below 10.0 Ohm·m by way of filling polyurethanes, epoxy and phenolformaldehyde resins with 0.15 to 2% by mass of current-conducting carbon fibres (cf. British Pat. No.1,570,249).

Known in the art is a process (cf. Japanese Pat. No. 55-26503) comprising manufacture of a flexible sheet material with a thickness of 0.15–0.20 mm having resistivity within the range of from 0.001 to 1.0 Ohm·m which is achieved by filling polyethylene, polypropylene and polyurethane with graphite and gas carbon black.

Known is a current-conducting composition (FRG Pat. No. 2,845,671) based on a thermoplastic filled by modifying additives and a carbon black with a specific surface area of 70 to 90 m$^2$/g intended for the formation of a semiconducting layer of a cable insulation and having resistivity of 4.5 to 5.0 Ohm·m.

U.S. Pat. No. 3,723,355 teaches a current conducting polymeric composition and a process for producing same. It has improved extrusion characteristics and abrasion resistance; it consists of 100 parts by mass of an elastomer, 40 to 400 parts by mass of a non-conducting filler and 2–15 parts by mass of gas-treated carbon with a surface area of 300–1,500 m$^2$/g, micropore void volume of up to 3 ml/g, macropore volume of 2–4 ml/g, as well as of a plastifying agent taken in the ratio of 1:1 to the gastreated carbon. Optimal results, as regards the resistivity, ($\delta$=0.4 Ohm·m) are obtained by filling 100 parts by mass of an elastomer with 15 parts by mass of gas-treated carbon and 100 parts by mass of alumina (in the absence of triethanolamine).

As it is seen from the above-described prior art, good current-conductance characteristics of polymeric compositions depend mainly on current-conducting fillers, i.e. special carbon blacks having high structurization and a well-developed surface; on mixtures of carbon blacks with graphites, as well as with powders of noble metals. These carbon blacks necessitate high capital expenditures for their manufacture, wherefore they are expensive and rarely available. They have but a low processibility, wherefore their distribution within a polymeric matrix is hindered, thus causing difficulties in the production of polymeric compositions and impairing the stability of the resistivity of such compositions. The attained level of current-conductivity of polymeric compositions containing such carbon blacks, though covering the range of 0.00001–10$^8$ Ohm·m, but is actually unknown due to the absence of data on the degree of compression of samples therefrom and the measurement procedures.

It is an object of the present invention to provide current-conducting composition having low resistivity, stable in time and during its processing.

SUMMARY OF THE INVENTION

This object is accomplished by a current-conducting composition comprising a polymeric base and a current-conducting carbon black; according to the present invention it contains, a carbon black with its carbon chemically combined with 0.18–0.5% by mass of boron and having a specific adsorption surface area of 60 to 110 $m^2/g$ with the following proportions of the components, parts by mass:

polymeric base: 100 current-conducting carbon black: 38–240.

The carbon black employed in the current-conducting composition according to the present invention has an increased electrical conductivity and a good processibility at the stage of its incorporation and a further uniform distribution within the polymeric matrix. Owing to such a filler the resulting current-conducting composition has resistivity which is stable both in time and at the stage of its processing and equal to 0.007–0.01 Ohm·m for extrusion-moulded materials and 0.0006 to 0.004 Ohm·m for sheets and compression-moulded articles. Furthermore, these current-conducting compositions have a good mechanical strength and flexibility which enables their use in aviation engineering, cable industry, tire manufacture and other industries.

In order to widen the scope of current-conducting compositions employed in different industries, it is advisable that as a polymeric base they incorporate natural rubber, isoprene rubber, butadiene-nitrile rubber, ethylene-propylene rubber, fluorinated rubber, urethane rubber, chloroprene rubber, silicone rubber or mixture thereof, as well as 1 to 3 parts by mass of a cross-linking agent and 5 to 40 parts by mass of a plastifying agent.

To enable the use of the current-conducting composition according to the present invention for the manufacture of a cable braiding with a polyethylene insulation of strands, it is advisable that it contain, as the polymeric base, a mixture of a polyvinyl chloride plasticate and butadiene-nitrile rubber at the following proportions of the components, parts by mass:

polyvinyl chloride plasticate: 80–90 butadiene-nitrile rubber: 10–20 current-conducting carbon black: 100–110.

To enable the use of the current-conducting composition according to the present invention for the manufacture of braidings of high-voltage cables, it is preferable that it contain polyethylene and a copolymer of styrene with divinyl, as the polymeric base, with the following proportions of the components, parts by mass:

polyethylene: 45–55 copolymer of styrene with divinyl: 45–55 current-conducting carbon black: 38–45.

DETAILED DESCRIPTION OF THE INVENTION

As it has been already mentioned hereinbefore, the electrical conductivity of the polymeric composition depend principally on the current-conducting filler. For the preparation of such a filler we have chosen the method of chemical modification of carbon blacks which are, by nature thereof, semiconductors characterized by a reduction of the electrical conductivity in the presence of impurities having their atoms capable of entering into chemical bonding with atoms of carbon at the sites of defects of its crystal lattice. As an acceptor additive boron compounds have been selected, which are introduced into carbonaceous substances without obeying the stoichiometry rules. At the stage of thermal decomposition of boron compounds boron atoms, while being in an active state, capture electrons belonging to carbon atoms; the efficiency of boron atoms grows with elevation of the interaction temperature.

In order to obtain current-conducting carbon blacks with an increased electrical conductivity and improved processibility at the stage of incorporation and a subsequent uniform distribution within the volume of the polymeric matrix at a high degree of extension, we have modified furance carbon blacks. These carbon blacks have an adsorption surface area of from 60 to 110 $m^2/g$ with a particle size of 38 to 42 nm, pH of an aqueous suspension of 6–9, adsorption of dibutyl phthalate of 95–125 ml/g, roughness coefficient of 1.13–1.18. By way of treatment of the carbon black with 5% aqueous solutions of borax or boric acid, followed by drying at a temperature of 110° to 120° C. and a heat-treatment in a weak reducing medium at a temperature within the range of from 2,000° to 2,500° C. we have obtained a carbon black which has its carbon chemically combined with 0.18 to 0.5% by mass of boron, a specific adsorption surface area of 60 to 110 $m^2/g$, a particle size of 30 Nm, adsorption of dibutylphthalate of 120 ml/g, roughness coefficient of 1.2, pH of an aqueous suspension of 7.0.

This content of chemically combined boron ensures the electrical conductivity of the resulting carbon black of 0.00017 Ohm·m (bulk density 400 $kg/m^3$).

In contrast to known carbon blacks the one produced according to the present invention without increasing the surface area (relative to the starting furnace carbon blacks) acquires an increased stable electrical conductivity and an ability of a good distribution within a polymeric matrix which results from the introduction of an acceptor additive of boron in an active atomic state into the structure of carbon.

For the preparation of the current-conducting composition according to the present invention, a current-conducting carbon black with its carbon being chemically combined with 0.18–0.5% by mass of boron and having a specific adsorption surface area of 60 to 110 $m^2/g$ is portion-wise introduced into a polymeric base and mixed with the latter in a mass ratio of 100:38–240 (parts by mass) respectively. The procedure of mixing is determined mainly by the nature of the polymeric base. As the polymeric base the following rubbers or mixes thereof may be used: natural rubber, isoprene rubber, butadiene-nitrile rubber, ethylene-propylene rubber, fluorinated rubber, chloroprene rubber, urethane rubber silicone rubber; in the course of intermixing of these rubbers with the above-specified carbon black 5 to 40 parts by mass of a plastifying agent and 1 to 3 parts by mass of a crosslinking agent are introduced.

The resulting rubber mixes after extrusion and vulcanization under appropriate conditions have a stable electrical resistance within the range of from 0.007 to 0.01 Ohm·m, while retaining physico-technological parameters of the vulcanizates.

Owing to the ability of the chemically-modified (by boron) carbon black of being well distributed within the polymeric matrix with ensuring a high degree of filling (up to 240 parts by mass per 100 parts by mass of a polymer) electrically-conducting compositions and compression-moulded sheet articles have been produced with a stable resistivity of up to 0.0006–0.004

Ohm·m simultaneously with retaining good physico-mechanical properties of the vulcanizates.

In the preparation of a current-conducting composition from a polyvinylchloride plasticate comprising a polyvinylchloride resin with a plastifying agent and a stabilizer, to facilitate its intermixing with the carbon black, butadiene-nitrile rubber is also introduced into the plasticate at the following proportions of the components, parts by mass:

polyvinylchloride plasticate: 80–90
butadiene-nitrile rubber: 10–20
current-conducting carbon black: 110–100.

The thus-obtained mixes are processed by extrusion into cable braidings with an electrical resistivity of 0.05–0.07 Ohm·m. In the case of filling 100 parts by mass of a polyvinylchloride plasticate with 240 parts by mass of the above specified carbon black current-conducting sheets and plates are produced by rolling and subsequent compression moulding; the latter have a stable electrical conductivity of 0.0007–0.001 Ohm·m and are intended for making various electrical engineering parts therefrom.

When a polyethylene polymeric matrix is used for the current-conducting composition according to the present invention, polyethylene is preliminarily mixed, by milling, with a copolymer of styrene and divinyl in the ratio of 45:55 (parts by mass). Into the thus-prepared mix the above-mentioned carbon black is introduced in an amount of 38 to 45 parts by mass per 100 parts by mass of the polymeric base. Braidings extruded from such current-conducting composition have a stable resistivity within the range of from 0.05 to 1.00 Ohm·m.

Using a simple process, we have produced current-conducting compositions possessing a whole range of properties depending on the polymeric base employed and the degree of filling, as well as having a stable resistivity, both with time and in the stage of processing, within the range of 0.007 to 0.01 Ohm·m. for extruded materials and from 0.0006 to 0.004 Ohm·m . for sheet and compression-moulded articles. The current-conducting compositions produced according to the present invention combine high conductivity characteristics with a sufficient mechanical strength and flexibility and are useful as materials for braidings of cable articles instead of copper ones, for the manufacture of fuel tanks, aircraft and automobile tires, various antistatic goods, electrodes, sensors, heating members.

EXAMPLE 1

Into a rubber mixer plasticates of natural rubber (65 parts by mass) and butadiene-nitrile rubber (35 parts by mass) are charged along with zinc whites (4 parts by mass), stearic acid (3 parts by mass), Neozone D (1 parts by mass) and carbon black in three equal portions (110 parts by mass) with its carbon being chemically combined with 0.5% by mass of boron and having the adsorption surface area of 80 $m^2/g$, as well as dibutylphthalate in the amount of 20 parts by mass. The initial mixing temperature is 60°–70° C., the final: 100°–110° C., mixing time is 14 minutes. Prior to extrusion Altax is introduced into the rubber mix in the amount of 3.9 g and peroxymon in the amount of 6.2 g per kg of the rubber mix. The rubber mix has plasticity of 0.28–0.30, extrudability of 1.3 $g/cm^3$. The optimum vulcanization at the temperature of 160° C. is 20 minutes. The vulcanizate has the tensile strenth of 9.0 MPa, relative elongation of 250%. The resistivity prior to stretching is 0.01 Ohm·m., after a 10-time stretching by 20%—0.05 Ohm·m. After ageing at the temperature of 70° C. for 96 hours the tensile strength variation is 5%, the relative elongation is changed by 10%. After ageing at the temperature of 100° C. for 10 days the resistivity prior to stretching is 0.01 Ohm·m, after a 10-time stretching by 20% it is equal to 0.03 Ohm·m. After 7 years of storage under storehouse conditions with temperature variation of from 0 to +35° C. the resistivity of the vulcanizate is 0.015 Ohm·m.

EXAMPLE 2

The mixing is effected in a manner similar to that described in the foregoing Example 1.

The mix consists of divinyl rubber (65 parts by mass), plastified butadiene-nitrile rubber (35 parts by mass). A carbon black with its carbon being chemically combined with 0.18% by mass of boron and having an adsorption surface area of 60 $m^2/g$ (100 parts by mass) and graphite (15 parts by mass) are introduced into the polymeric base in three portions together with a softener (20 parts by mass). The rubber mix has plasticity of 0.24, extrusivity of 1.2 $g/cm^3$. The optimum vulcanization at the temperature of 160° C. is 20 minutes. The vulcanizate has tensile strength of 7 MPa, relative elongation of 330%, resistivity prior to stretching of 0.007 Ohm·m, that after a 10-time stretching by 20%—0.01 Ohm·m. After ageing at the temperature of 70° C. for 96 hours the tensile strength variation is 5%, that of the relative elongation is 10%. After ageing at the temperature of 100° C. for 10 days the resistivity prior to stretching is 0.007 Ohm·m, after a 10-time stretching by 20%—0.012 Ohm·m. After 7 years of storage under storehouse conditions with temperature variations from 0° to +40° C. the vulcanizate resistivity is equal to 0.007 Ohm·m.

EXAMPLE 3

Using laboratory mill, a 200×450 mm polyvinyl chloride plasticate (100 parts by mass) is blended with butadiene-nitrile rubber (21.3 parts by mass). The mix is added with carbon black having its carbon chemically combined with 0.3% by mass of boron and possessing specific adsorption surface area of 100 $m^2/g$ (87.5 parts by mass), as well as with stearic acid (0.34 part by mass) and dibutyl sebacate (25 parts by mass). The mixing is carried out at the temperature of 175°±15° C. for a period of 10–12 minutes. The thus-prepared composition is cut into strips, granulated and compressed at the temperature of 180°±1° C., maintained under the pressure of 11 MPa for 10 minutes and then cooled to a temperature of 30°–40° C. The composition has resistivity prior to stretching of 0.02 Ohm·m, after a 10-time stretching by 20%—0.05 Ohm·m; the breaking tension stress is 6 MPa, relative elongation 150%, brittleness temperature is −40° C. After extrusion at a temperature within the range of from 120° to 170° C. its resistivity is 0.07–0.05 Ohm·cm. After a thermal ageing at the temperature of 80° C. for 30 days and an accelerated ageing simulating 3 years of storage under shed the resistivity is within the range of from 0.01 to 0.14 Ohm·m.

EXAMPLE 4

Using laboratory mill, low-density polyethylene (100 parts by mass) is mixed at a temperature of 130°–150° C. with a copolymer of styrene and divinyl (100 parts by mass), syntanol (1 part by mass), carbon black (85 parts by mass) having its carbon chemically combined with 0.4% by mass of boron and with the specific adsorption surface area of 90 $m^2/g$. The mixing time, including rolling of the web, is 15–17 minutes. The produced composition is cut into strips and granulated. Plates compressed at a temperature of 165°–176° C. under a specific pressure of 4.5–5.5 MPa and cooled to a temperature of 30°–40° C. have a melt index of $4.1\times10^{-3}$ g/s at the temperature of 190° C. under the load of 98 N; breaking tension stress 12.8 MPa, relative elongation at rupture is 536%, resistivity 0.4 Ohm·m.

EXAMPLE 5

In a rubber mixer ethylene-propylene rubber is processed at a temperature of 50°–60° C. (100 parts by mass), whereafter Altax (1 part by mass), Neozone D (0.5 part by mass), zinc whites (5 parts by mass), stearic acid (3 parts by mass) are introduced along with three equal portions of a carbon black (120 parts by mass) with its carbon chemically combined with 0.5% by mass of boron and having specific adsorption surface area of 110 $m^2/g$ and graphite (13 parts by mass) in a plastifying agent. The mixture is rolled in the mill for 10 minutes at a clearance of 5–8 mm and at a temperature of 50°–60° C., whereafter peroxymon (4.2 parts by mass) is introduced and the mix is then cut into rolls. The mixing time is 20 minutes. Temperature is maintained within the range of from 60° to 100° C., plasticity is 0.15. The plates are vulcanized at the temperature of 160° C. for 20 minutes. Swelling from 2,160 hours in a 20% sulphuric acid and a 20% caustic soda is zero. Plates with the thickness of 0.25 mm have resistivity of 0.004 Ohm·m.

EXAMPLE 6

A plastified butadiene-nitrile rubber (100 parts by mass, is mixed in a rubber mixer with stearic acid (2 parts by mass), zinc whites (6 parts by mass) and Neozone D (1 part by mass), whereafter in three equal portions a carbon black is introduced (240 parts by mass) with its carbon being chemically combined with 0.3% by mass of boron and having its specific adsorption surface area of 90 $m^2/g$ and graphite (120 parts by mass). The mixing time is 16 minutes, temperature is maintained within the range of from 70° to 130° C. Prior to compression-moulding peroxymon is introduced into the rubber mix (11.9 g per kg of the rubber mix). The optimum vulcanization at the temperature of 180° C. is 5 minutes; resistivity of plates with a thickness of 0.25–0.30 mm is equal to 0.0006 Ohm·m.

EXAMPLE 7

Using laborytory mill of 200×450 mm, at the temperature of 40° C. a silicone rubber (100 parts by mass) is mixed with a carbon black having its carbon chemically combined with 0.2% by mass of boron and with the specific adsorption surface area of 80 $m^2/g$, whereafter peroxymon F-40 is introduced (8 parts by mass). The mix is vulcanized at the temperature of 150° C. for 20 minutes. The vulcanizate has its tensile strength of 2.3 MPa, relative elongation of 408%, resistivity of 0.03–0.035 Ohm·m.

What is claimed is:

1. A process for producing a current conducting composition comprising a polymeric base and a current-conducting carbon black which comprises (a) treating carbon black with a 5% aqueous solution of borax or boric acid.

(b) drying at 110°–120° C.

(c) heat treating in a weak reducing medium at a temperature within the range of about 2000°–2500° C., resulting in a current conducting carbon black, and (d) introducing the current conducting carbon black into a polymeric base of thermoplastics, thermosetting resins or elastomers wherein the current conducting carbon black is chemically combined with 0.18–0.5% by mass of boron and has a specific adsorption surface area of 60–110 $m^2/g$, and the composition contains the following proportions of the components, parts by mass:

polymeric base: 100 current-conducting carbon black: 38–240.

2. A process, as in claim 1, wherein said composition has a stable resistivity of 0.0006 to 0.004 ohm·m.

3. A process, as in claim 1, wherein the polymeric base is chosen from one of the group consisting of natural rubber, isoprene rubber, butadiene-nitrite rubber, ethylene-propylene rubber, fluorinated rubber, urethane rubber. silicone rubber, further vulcanizing and extruding said composition, said composition having a stable electrical resistance of 0.007 to 0.01 ohm·m.

4. A process, as in claim 1, wherein said composition has a stable resistivity of 0.0006 to 0.4 ohm·M.

5. A process, as in claim 1, wherein the polymeric base is chosen from one of the group consisting of natural rubber, isoprene rubber, butadiene-nitrite rubber, ethylene-propylene rubber, fluorinated rubber, urethane rubber, silicone rubber, further vulcanizing and extruding said composition, said composition having a stable electrical resistance of 0.0006–0.035 ohm·M.

* * * * *